US007935040B2

(12) United States Patent
Moskowich

(10) Patent No.: US 7,935,040 B2
(45) Date of Patent: May 3, 2011

(54) METHOD AND APPARATUS FOR PUSH UP EXERCISES

(76) Inventor: Stan L. Moskowich, Marlboro, NJ (US)

( * ) Notice: Subject to any disclaimer, the term of this patent is extended or adjusted under 35 U.S.C. 154(b) by 0 days.

(21) Appl. No.: 12/838,848

(22) Filed: Jul. 19, 2010

(65) Prior Publication Data

US 2011/0065555 A1 Mar. 17, 2011

Related U.S. Application Data

(60) Provisional application No. 61/276,410, filed on Sep. 11, 2009.

(51) Int. Cl.
*A63B 71/00* (2006.01)

(52) U.S. Cl. ..... 482/141; 482/44

(58) Field of Classification Search ..... 482/44–50, 482/62, 115–118, 135–137, 141, 148, 910; D21/662, 665, 686; 280/655, 655.1, 47.315, 280/47.36, 47.371

See application file for complete search history.

(56) References Cited

U.S. PATENT DOCUMENTS

| | | | | | |
|---|---|---|---|---|---|
| 574,456 | A | | 1/1897 | Seitz | 16/406 |
| 2,230,989 | A | | 2/1941 | Barish | 384/499 |
| 2,351,293 | A | | 6/1944 | Saunders | 482/147 |
| 2,599,434 | A | | 6/1952 | Crane | 16/406 |
| 3,063,714 | A | | 11/1962 | Krauss | 482/147 |
| 3,100,639 | A | | 8/1963 | Boneweitz | 482/147 |
| 3,115,338 | A | | 12/1963 | Acs et al. | 482/141 |
| 3,454,273 | A | | 7/1969 | Vogt | 462/147 |
| 3,484,894 | A | | 12/1969 | Fletcher | 16/442 |
| 3,730,521 | A | | 5/1973 | Sellman | 482/147 |
| 4,351,525 | A | | 9/1982 | Rozenblad | 482/141 |
| 4,383,488 | A | | 5/1983 | Macho et al. | 108/129 |
| D274,411 | S | | 6/1984 | Sidrak | D10/65 |
| 4,548,092 | A | | 10/1985 | Strong, Jr. | 74/473.14 |
| 4,610,448 | A | | 9/1986 | Hill | 482/141 |
| 4,624,276 | A | | 11/1986 | Allen | 135/25.4 |
| 4,647,056 | A | * | 3/1987 | Baker | 280/37 |
| 4,663,802 | A | | 5/1987 | Kunzler | 16/408 |
| 4,700,945 | A | * | 10/1987 | Rader | 482/132 |
| 4,761,012 | A | * | 8/1988 | Dames | 280/38 |
| 4,768,778 | A | | 9/1988 | Thomas, Jr. | 482/141 |
| 4,799,306 | A | | 1/1989 | Collins | 29/453 |
| 4,828,310 | A | | 5/1989 | Schmidt | 294/153 |
| 4,858,912 | A | | 8/1989 | Boyd | 482/45 |
| 4,858,916 | A | | 8/1989 | Beaumont | 482/105 |
| 4,892,305 | A | * | 1/1990 | Lynch | 482/132 |
| 4,905,540 | A | | 3/1990 | Hughes | 74/579 E |
| 5,084,940 | A | | 2/1992 | Loffler | 16/412 |

(Continued)

*Primary Examiner* — Loan Thanh
*Assistant Examiner* — Daniel F. Roland
(74) *Attorney, Agent, or Firm* — Walter J. Tencza, Jr.

(57) ABSTRACT

An apparatus having a handle device having a handle, and a base having a top surface and an opposing bottom surface. The apparatus may be used with an identical second apparatus by an individual for performing a push up exercise. The handle device may be connected to the base so that the handle device can rotate from a first state in which the handle is temporarily fixed at a position which is closer to the top surface of the base than the bottom surface of the base, to a second state in which the handle is temporarily fixed at a position which is closer to the bottom surface of the base than the top surface of the base. The handle device may include a C-shaped member having a first end and a second end, wherein the C-shaped member can rotate with respect to the base about an axis passing through the first end and the second end of the C-shaped member.

9 Claims, 16 Drawing Sheets

U.S. PATENT DOCUMENTS

| | | | | |
|---|---|---|---|---|
| 5,226,868 | A | 7/1993 | Montgomery | 482/141 |
| 5,256,127 | A | 10/1993 | Yeh | 482/146 |
| 5,358,463 | A | 10/1994 | Fuentes | 482/141 |
| 5,399,133 | A * | 3/1995 | Haber et al. | 482/49 |
| 5,485,654 | A | 1/1996 | Nespodzany, Jr. | 16/422 |
| 5,632,707 | A | 5/1997 | Daniel | 482/8 |
| 5,653,458 | A * | 8/1997 | Chaparian | 280/30 |
| 5,713,823 | A | 2/1998 | Walendzak | 482/42 |
| 5,728,031 | A * | 3/1998 | Honeycutt | 482/83 |
| 5,766,112 | A | 6/1998 | Chuan | 482/44 |
| 5,766,119 | A | 6/1998 | Clark | 482/146 |
| 5,845,978 | A | 12/1998 | Jung | 312/244 |
| 5,870,774 | A * | 2/1999 | Legenstein | 2/24 |
| 5,937,440 | A * | 8/1999 | Ferriter | 2/24 |
| 6,017,296 | A | 1/2000 | Tang | 482/132 |
| 6,052,868 | A | 4/2000 | Chen | 16/110.1 |
| 6,101,086 | A | 8/2000 | Kim | 36/679.55 |
| 6,129,651 | A | 10/2000 | Denaro | 482/141 |
| 6,186,930 | B1 | 2/2001 | Ignaczak | 482/141 |
| 6,219,845 | B1 * | 4/2001 | Ferriter | 2/24 |
| 6,443,675 | B1 | 9/2002 | Kopras | 409/182 |
| D464,095 | S | 10/2002 | Yu | D21/684 |
| 6,488,293 | B1 * | 12/2002 | Mitchell et al. | 280/47.34 |
| 6,503,179 | B2 | 1/2003 | Miraflor | 482/141 |
| D469,831 | S | 2/2003 | Tuccillo | D21/689 |
| 6,578,236 | B2 | 6/2003 | Munari | 16/444 |
| 6,845,991 | B1 * | 1/2005 | Ritucci et al. | 280/30 |
| 6,938,740 | B2 * | 9/2005 | Gandy | 190/18 A |
| 6,942,605 | B1 * | 9/2005 | Sukhovitsky | 482/132 |
| D523,493 | S | 6/2006 | Horton | D21/662 |
| 7,063,646 | B1 | 6/2006 | Slimi | 482/45 |
| 7,134,987 | B2 | 11/2006 | Goldstein | 482/141 |
| 7,197,770 | B1 * | 4/2007 | Warren | 2/24 |
| 7,201,385 | B2 * | 4/2007 | Renz et al. | 280/79.11 |
| 7,238,147 | B2 | 7/2007 | Mills | 482/106 |
| 7,252,295 | B2 * | 8/2007 | Bludworth | 280/33.991 |
| 7,364,172 | B1 * | 4/2008 | Archer | 280/79.5 |
| 7,377,888 | B2 | 5/2008 | Godbold | 482/141 |
| D576,693 | S | 9/2008 | Khubani | D21/686 |
| 7,424,768 | B2 | 9/2008 | Beruscha | 16/422 |
| D579,503 | S | 10/2008 | Hauser | D21/662 |
| D580,998 | S | 11/2008 | Lin | D21/686 |
| 7,503,884 | B1 | 3/2009 | Schall | 482/141 |
| 7,553,267 | B1 | 6/2009 | Hauser | 482/141 |
| 7,563,216 | B1 | 7/2009 | Kest | 482/141 |
| 7,681,248 | B2 * | 3/2010 | Legenstein | 2/24 |
| 2002/0032952 | A1 | 3/2002 | Munari | 16/406 |
| 2003/0216221 | A1 | 11/2003 | Iverson | 482/51 |
| 2004/0266593 | A1 | 12/2004 | Schwendeman | 482/140 |
| 2005/0003931 | A1 | 1/2005 | Mills | 482/5 |
| 2005/0227831 | A1 | 10/2005 | Mills | 482/106 |
| 2006/0014615 | A1 | 1/2006 | Godbold | 482/141 |
| 2006/0035771 | A1 | 2/2006 | Gant | 482/141 |
| 2006/0040809 | A1 | 2/2006 | Godbold | 482/141 |
| 2007/0184951 | A1 | 8/2007 | James | 482/141 |
| 2010/0144502 | A1 * | 6/2010 | Hinds et al. | 482/139 |

* cited by examiner

METHOD AND APPARATUS FOR PUSH UP EXERCISES

CROSS REFERENCE TO RELATED APPLICATION(S)

This application claims the priority of U.S. provisional patent application Ser. No. 61/276,410, filed on Sep. 11, 2009, titled "Revolving push up devices", inventor and applicant Stan L. Moskowich.

FIELD OF THE INVENTION

This invention relates to push up exercise devices.

BACKGROUND OF THE INVENTION

In the area of push-up exercise devices there are variety of exercise devices, as exemplified by U.S. Pat. No. 7,553,267 to Hauser. Hauser, discloses an exercise rotatable device that requires an individual to perform push away exercise routines. However, among other deficiencies, the Hauser exercise device is limited in directions of movement to effectively perform chest, upper back and abdominals exercises; and does not offer varying challenge levels of movements.

Another upper body exercise device is disclosed by U.S. Pat. No. 6,503,179 to Miraflor, which discloses a spring roller exerciser device. The spring roller exercise device is used in a pectorals-focused exercising routine that allows varying types of movements to be performed, however, the device itself does not provide push up exercises.

SUMMARY OF THE INVENTION

In at least one embodiment of the present invention an apparatus is provided comprising a handle device having a handle, and a base having a top surface and an opposing bottom surface. The apparatus may be used with an identical second apparatus by an individual for performing a push up exercise.

The handle device may be connected to the base so that the handle device can be placed in a first state in which the handle is temporarily fixed at a position which is closer to the top surface of the base than the bottom surface of the base, and so that the handle device can be placed in a second state in which the handle is temporarily fixed at a position which is closer to the bottom surface of the base than the top surface of the base. The handle device may be connected to the base so that the handle device is adapted to rotate with respect to the base in order to change the handle device from the first state to the second state.

The handle device may include a C-shaped member having a first end and a second end, wherein the first end of the C-shaped member is rotatably mounted to a first side of the base, and the second end of the C-shaped member is rotatably mounted to a second side of the base, which is opposite the first side of the base, so that the C-shaped member can rotate with respect to the base about an axis passing through the first end and the second end of the C-shaped member.

The handle device may include a first further member having a first end and a second end. The first further member may be attached at its first end substantially at a midpoint of the C-shaped member, and the first further member may be attached at its second end to the handle. The handle device may be connected to the base, so that the handle device is adapted to move with respect to the base without rotating.

The apparatus may further include one or more wheels which protrude outward from the bottom surface of the base. The apparatus may further include a locking mechanism for temporarily locking the handle device in the first state, and an unlocking mechanism for allowing the handle device to be changed from the first state to the second state. The top surface of the base of the apparatus may include a non-skid material.

A method in accordance with an embodiment of the present invention may include placing a first apparatus and a second apparatus on a floor surface, wherein the first apparatus and the second apparatus are identical and are as previously described. The method may further include simultaneously gripping a first handle of the first apparatus with a left hand of an individual, gripping a second handle of the second apparatus with a right hand of the individual, and performing a pushup exercise using the first apparatus and the second apparatus.

In at least one embodiment of the present invention an apparatus is provided which includes a base having two functioning surfaces, a handle device, and a locking mechanism. The handle device can be rotated and can be translated into different states or positions with respect to the base. The apparatus, particularly when used in combination with an identical second apparatus, allows an individual user to execute a variety of push up exercises including a common push up, as well as push up exercises where the two apparatus are rolled outward or forward.

One or more embodiments of the present invention provide a revolving push up device having wheels and a revolving or rotating handle that allows individuals to perform advanced muscle-building exercise. One or more embodiments provide an innovative core training product that allows a variety of core training exercises, including common pushups as well as dynamic roll outward and roll forward workouts that sculpt the upper body faster and more efficiently.

One or more embodiments of the present invention can be used for conventional push up or push away exercise and can also be used for outward and forward extension and/or push away or up exercise by use of wheels incorporated into a housing.

One or more embodiments of the present invention provide a revolving handle that allows both sides a base to be used for exercises. In one or more embodiments the base includes friction surface and an opposite surface through which a plurality of wheels protrude through openings in the surface.

One or more embodiments of the present invention provide a rotating handle which can rotate one hundred eighty degrees perpendicularly to a base and which is attached to a vertical side of the base. A locking mechanism may also be provided which temporarily fixes the handle preventing the handle from moving during exercises. The revolving handle allows use of either the friction surface or the protruding wheels.

DETAILED DESCRIPTION OF THE DRAWINGS

Figure 1:
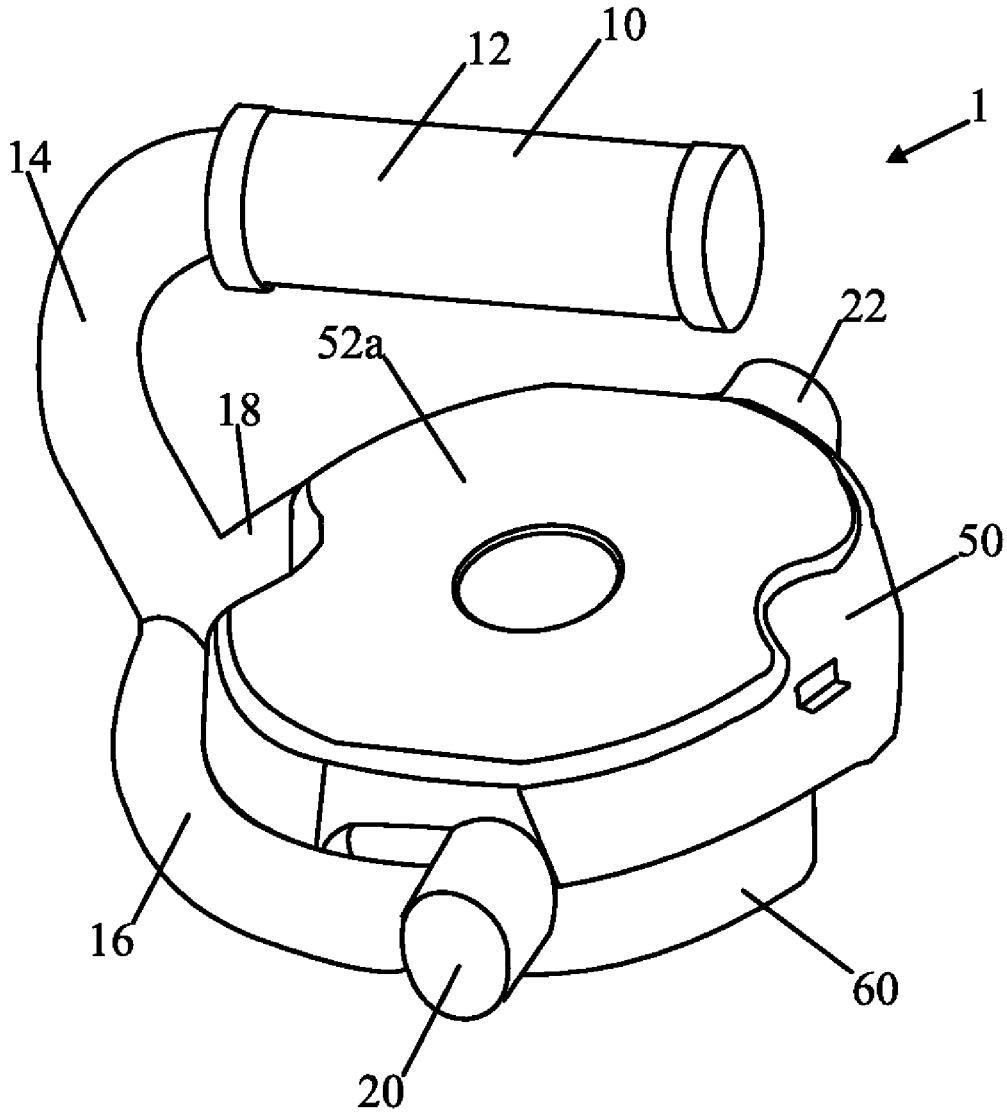
FIG. 1 shows a top perspective view of an apparatus in accordance with an embodiment of the present invention, with the apparatus in a first state, wherein a handle is above a top surface of the apparatus.

FIG. 1 shows a top perspective view of an apparatus 1 in accordance with an embodiment of the present invention, with the apparatus 1 in a first state, wherein a handle 12 is above a top surface 52*a* of a cover 50 or top housing of the apparatus 1.

Figure 2:
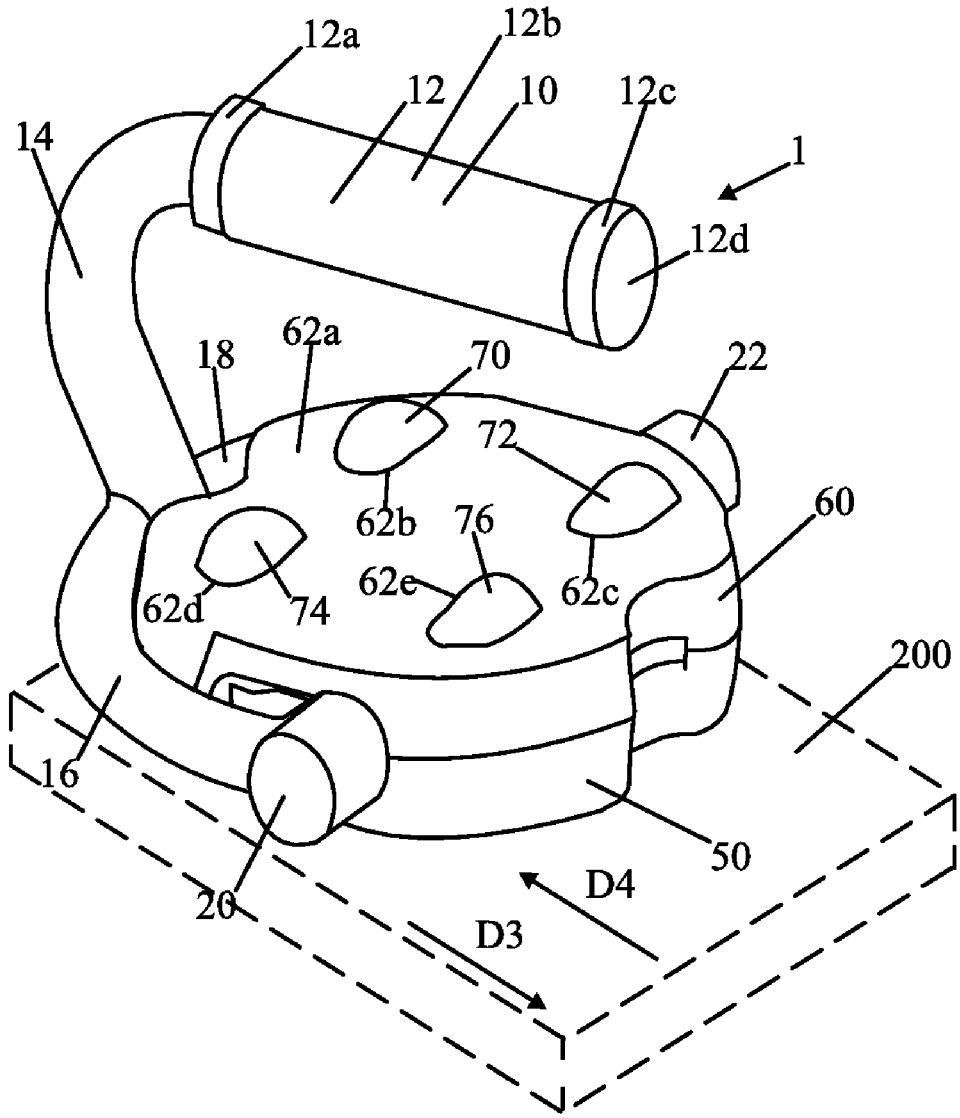
FIG. 2 shows a bottom perspective view of the apparatus of FIG. 1, with the apparatus in a second state, wherein the handle is above a bottom surface of the apparatus.

The handle 12 is part of a handle device 10. FIG. 2 shows a bottom perspective view of the apparatus of 1, with the apparatus 1 in a second state, wherein the handle 12 is above a bottom surface 62*a* of a bottom housing 60 of the apparatus 1. The handle device 10 has been rotated 180 degrees to go from the first state of FIG. 1 to the second state of FIG. 2. In addition, the handle device 10 has been translated from the first state of FIG. 1 to the second state of FIG. 2.

The surface 52*a* may be a substantially non slip or non slip frictional surface, such as a rubber surface. When the handle device 10 has been rotated into the state of FIG. 2, where the handle 12 is closer to the surface 62*a* than the surface 52*a*, the surface 52 lies on a floor surface, such as floor surface 200, shown by dashed lines in FIG. 2. In FIG. 2, the surface 52 makes contact with and frictionally engages the floor surface 200 so that the apparatus 1 does not slide or does not easily slide or move translationally with respect to the floor surface 200 such as when subject to forces in the directions D3 or D4. The floor surface 200, on which the apparatus 1 may be used, and on which the surface 52*a* may rest, may include a hardwood floor surface, a carpeted surface or any other surface.

The combination of the top housing or cover 50 and the bottom housing 60 can be called a base.

Figure 3:
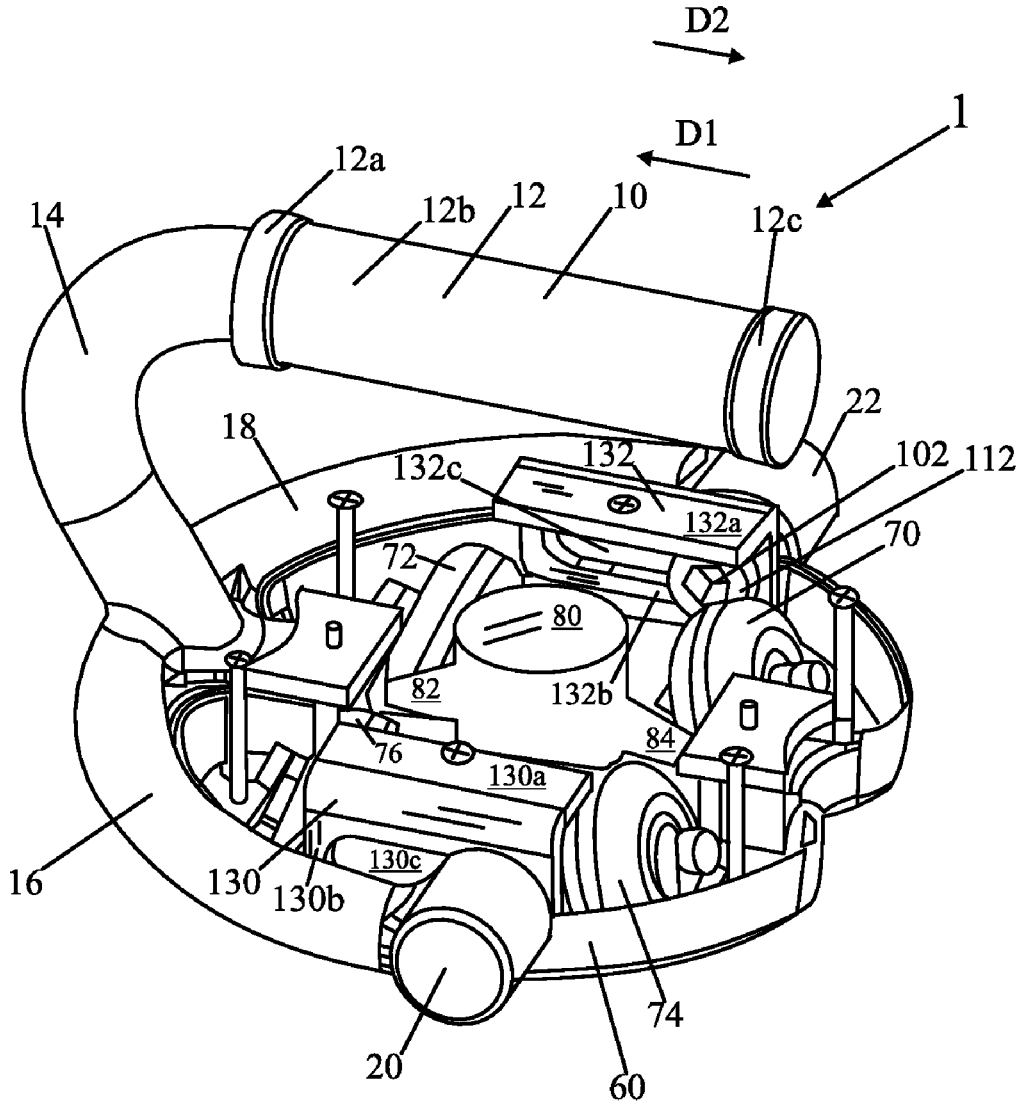
FIG. 3 shows a top perspective view of part of the apparatus of FIG. 1 with a cover removed and with the handle oriented as in the first state of FIG. 1.
Figure 4:
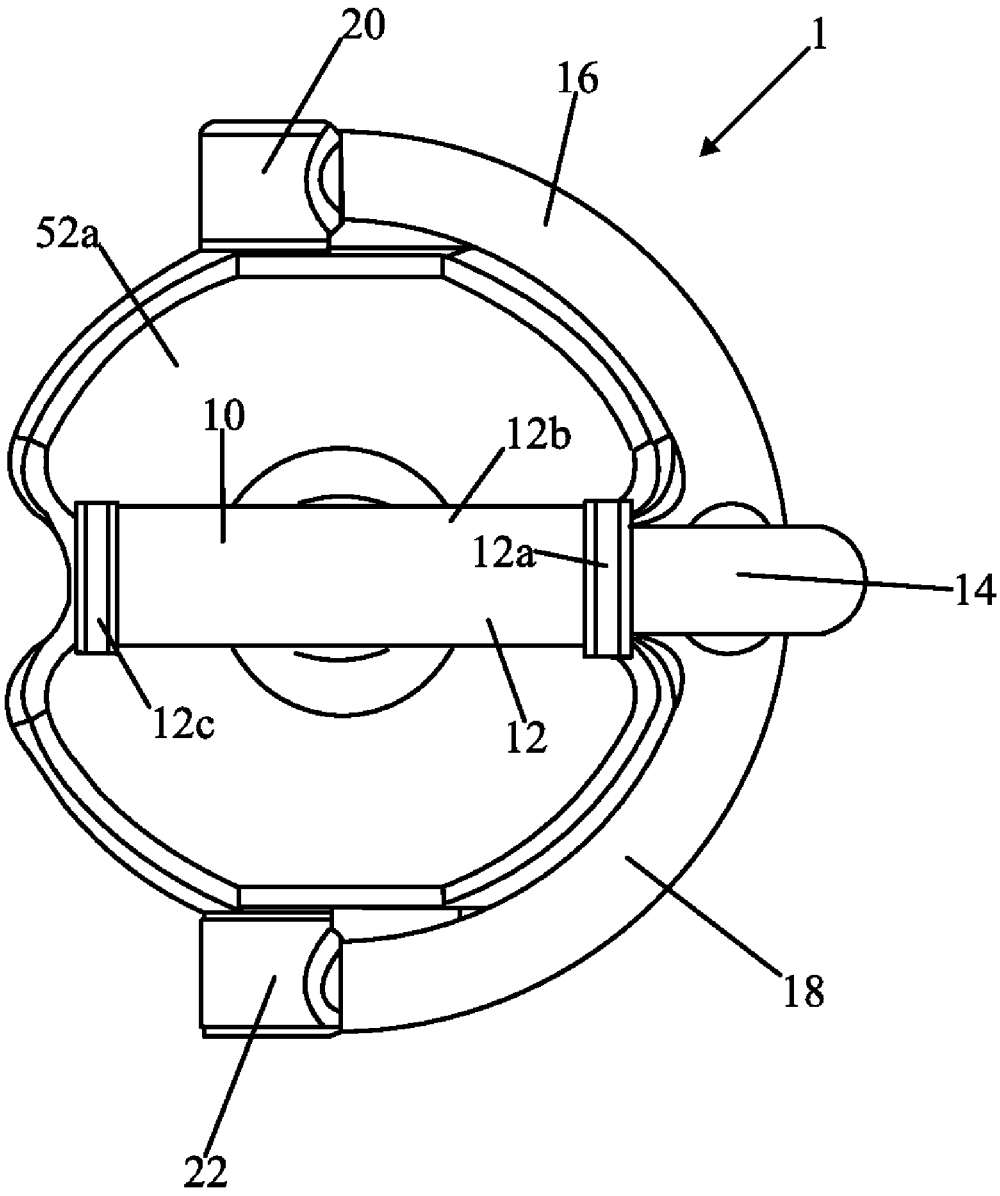
FIG. 4 shows a top view of the apparatus of FIG. 1, with the apparatus in the first state.

FIG. 3 shows a top perspective view of part of the apparatus 1 with the cover or top housing 50 removed and with the handle 12 oriented as in the first state of FIG. 1. FIG. 4 shows a top view of the apparatus 1 of FIG. 1, with the apparatus 1 in the first state.

Figure 5:
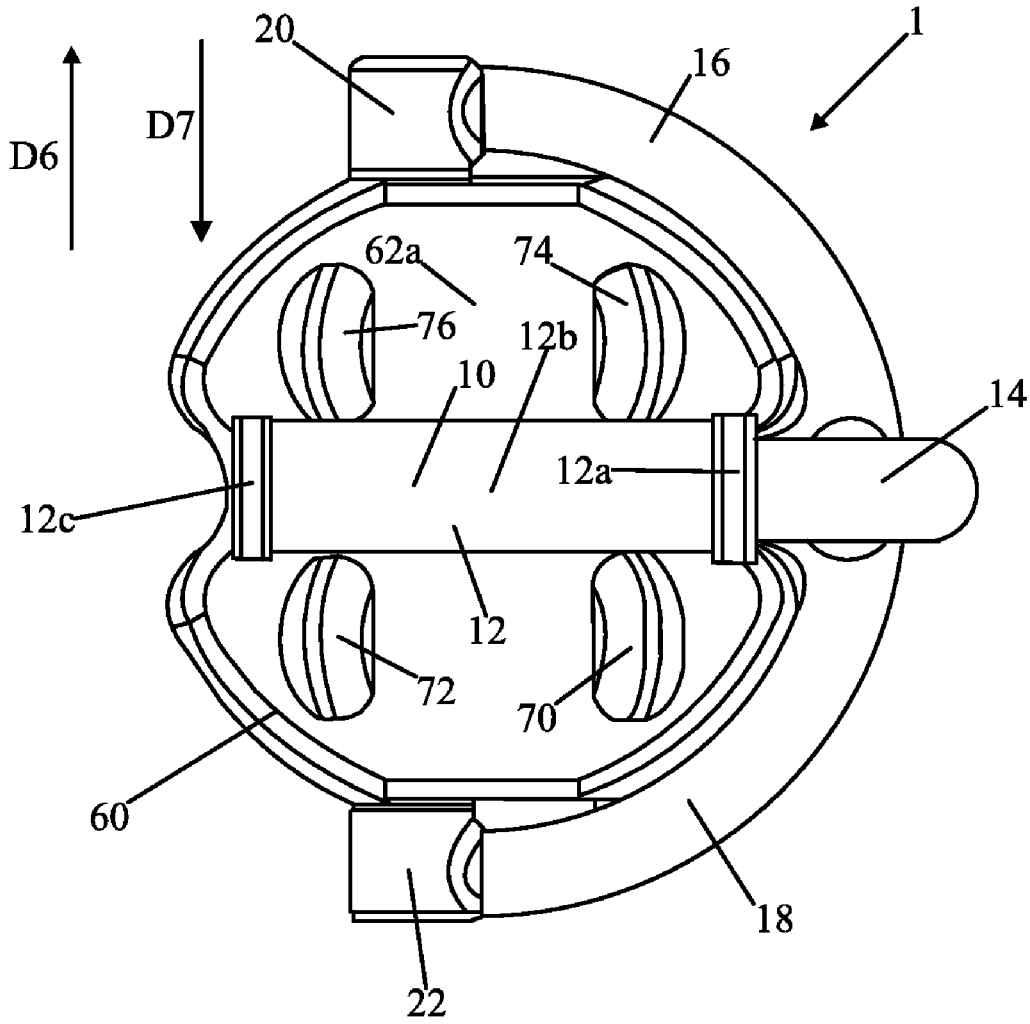
FIG. 5 shows a bottom view of the apparatus of FIG. 1, with the apparatus in the second state.
Figure 6:
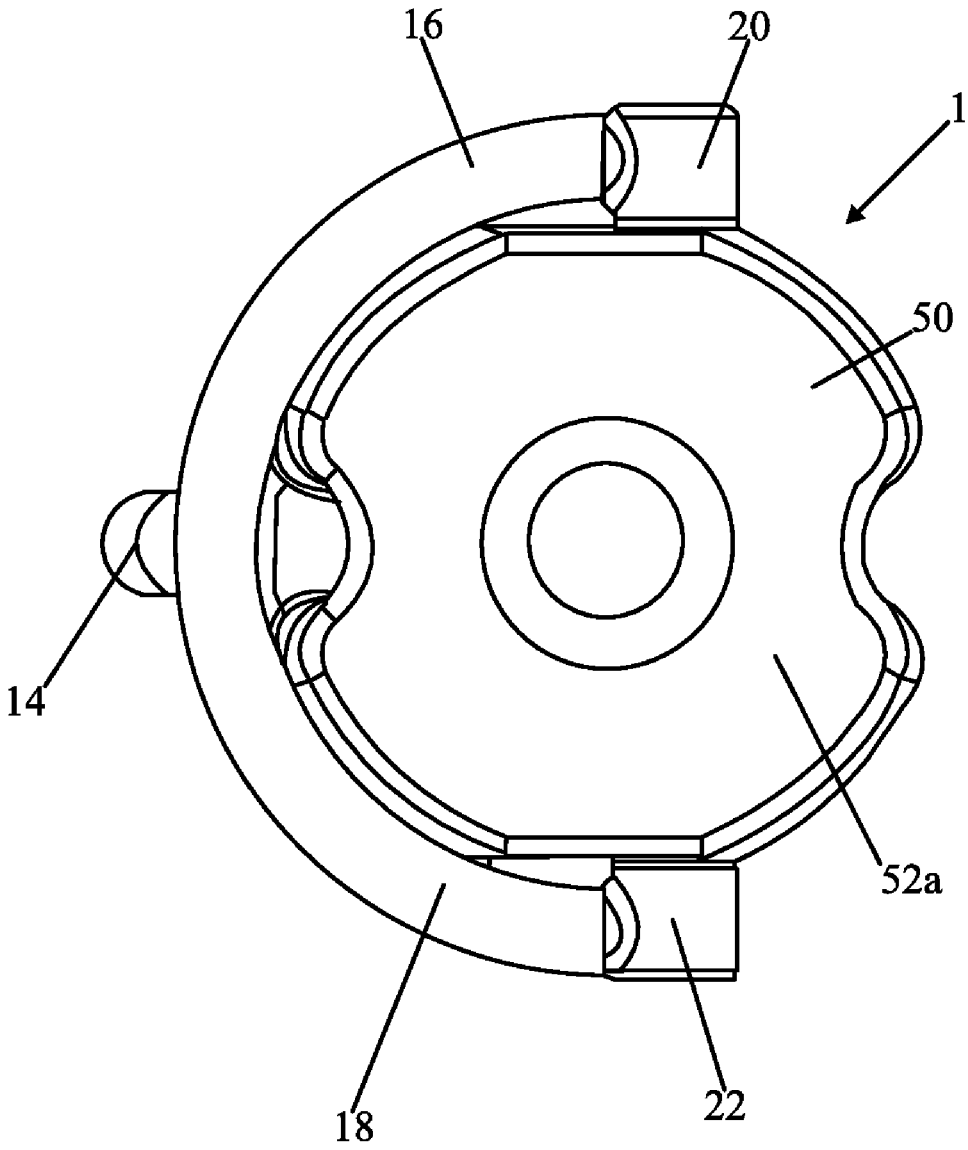
FIG. 6 shows a top view of the apparatus of FIG. 1, with the apparatus in the second state.
Figure 7:
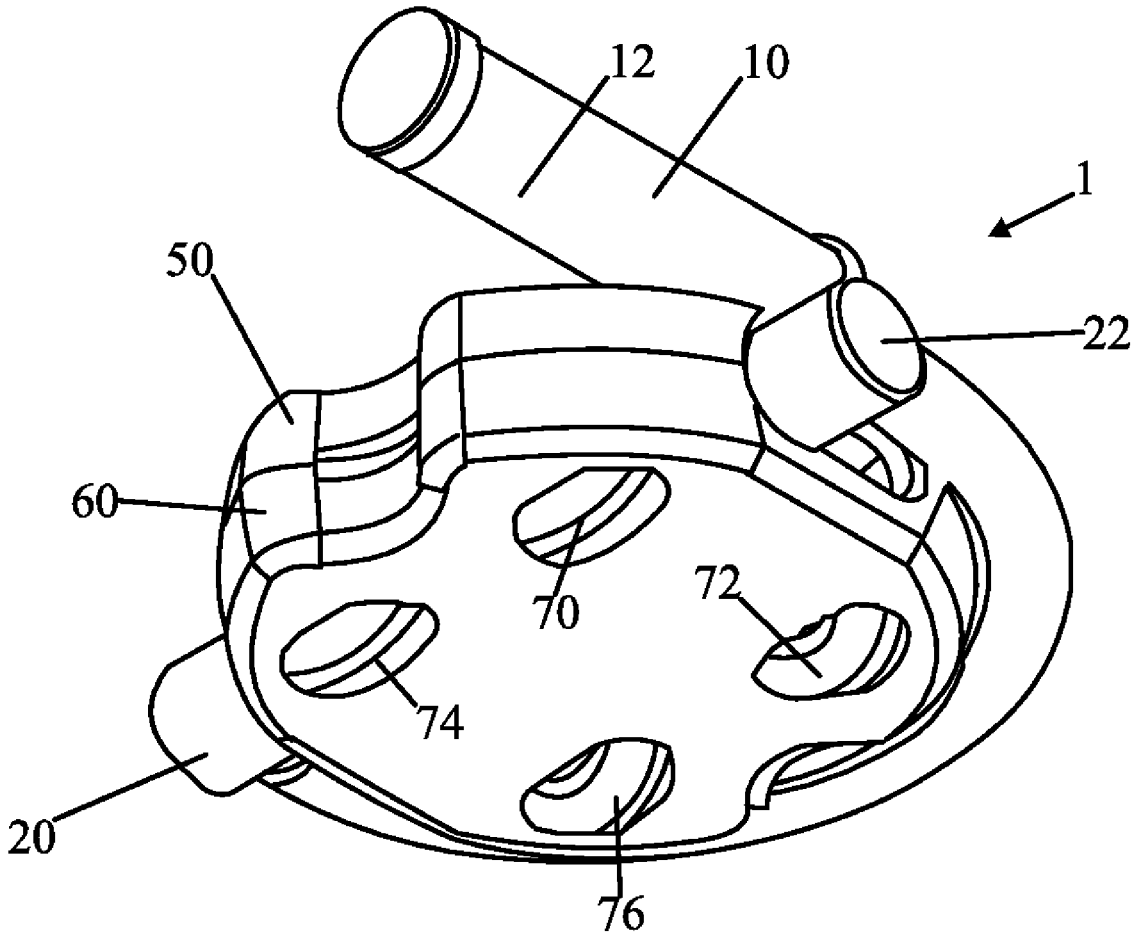
FIG. 7 shows a front bottom perspective view of the apparatus of FIG. 1, with the apparatus in the first state.
Figure 8:
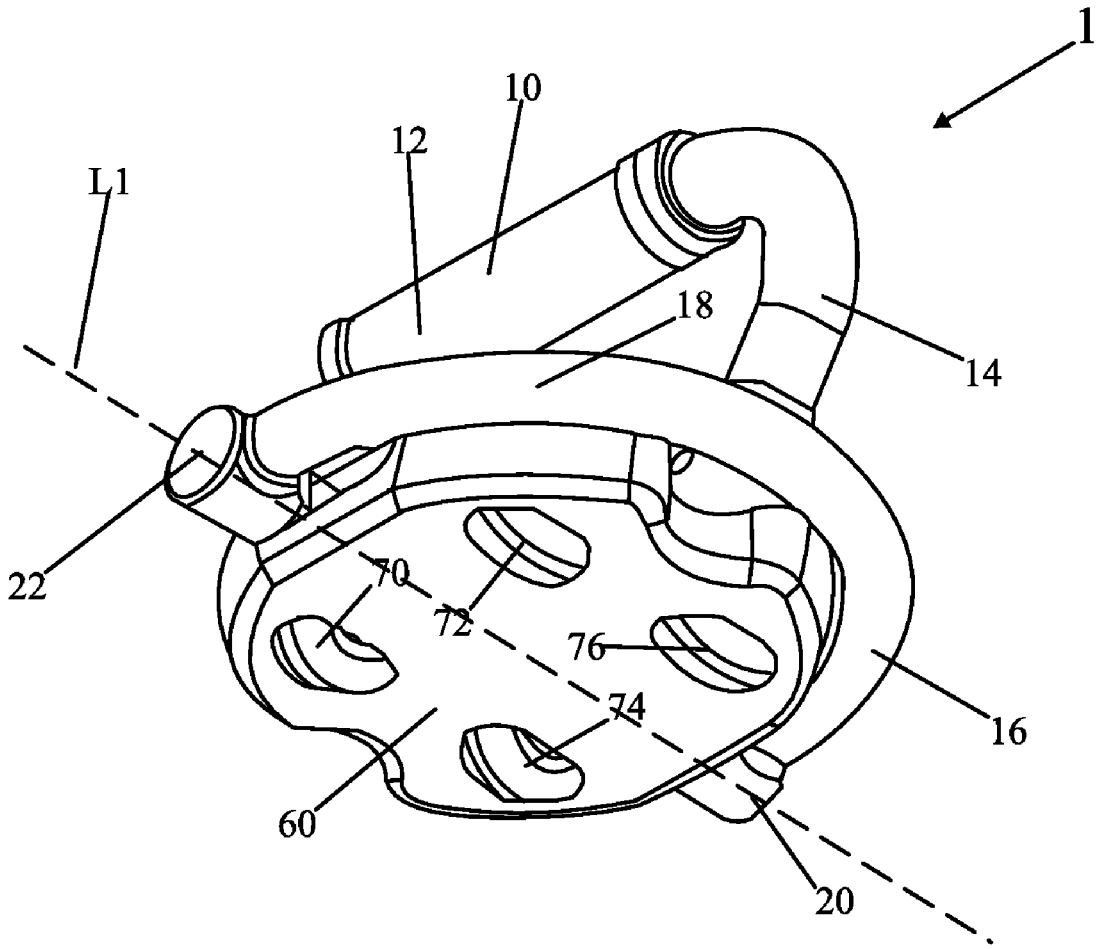
FIG. 8 shows a rear bottom perspective view of the apparatus of FIG. 1 with the apparatus in the first state.
Figure 9:
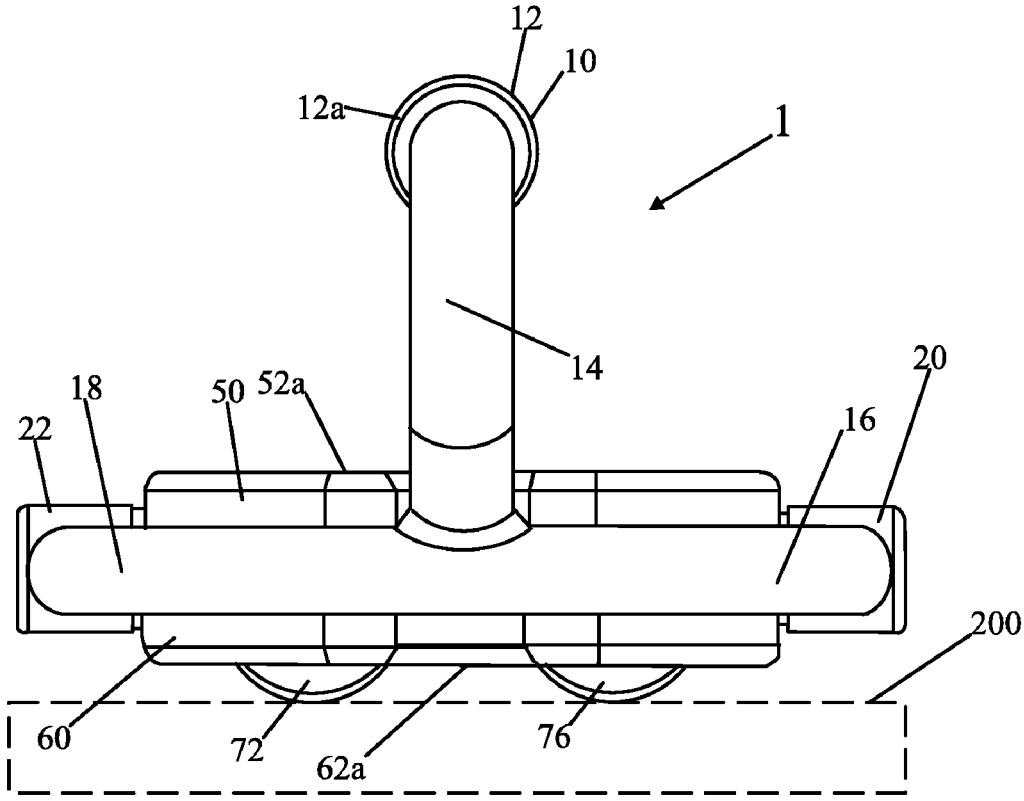
FIG. 9 shows a rear view of the apparatus of FIG. 1, with the apparatus in the first state.
Figure 10:
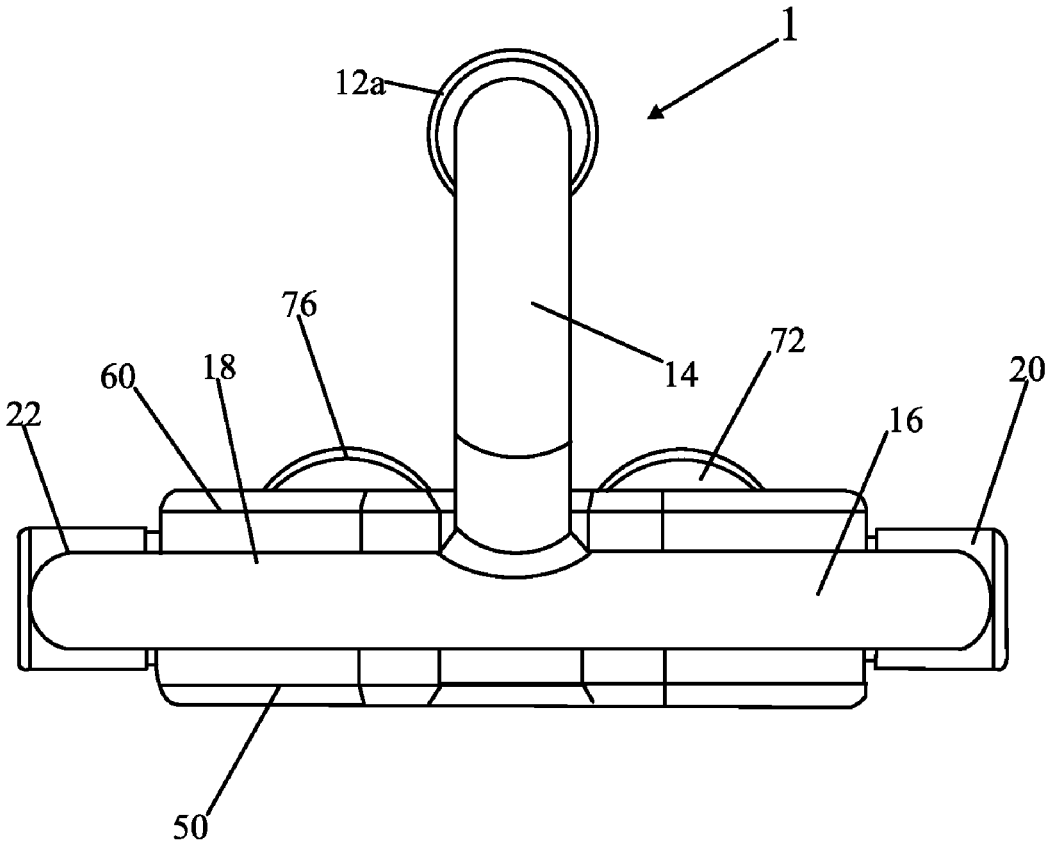
FIG. 10 shows a front view of the apparatus of FIG. 1, with the apparatus in the second state.
Figure 11:
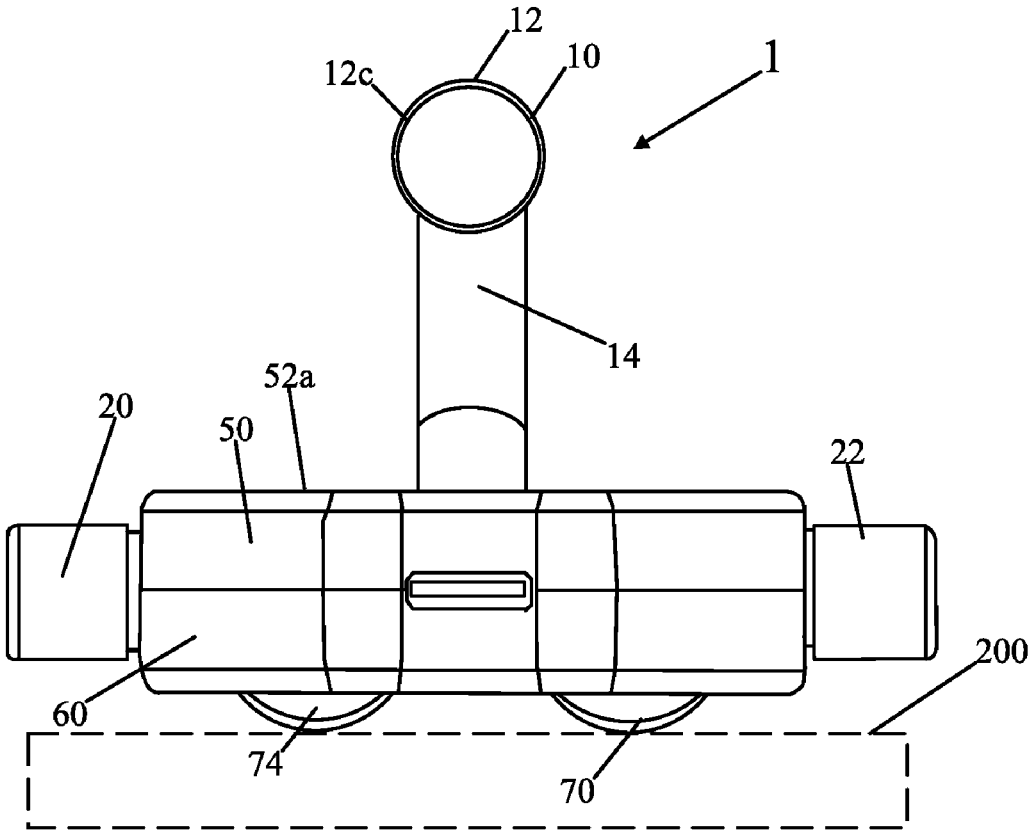
FIG. 11 shows a front view of the apparatus of FIG. 1, with the apparatus in the first state.
Figure 12:
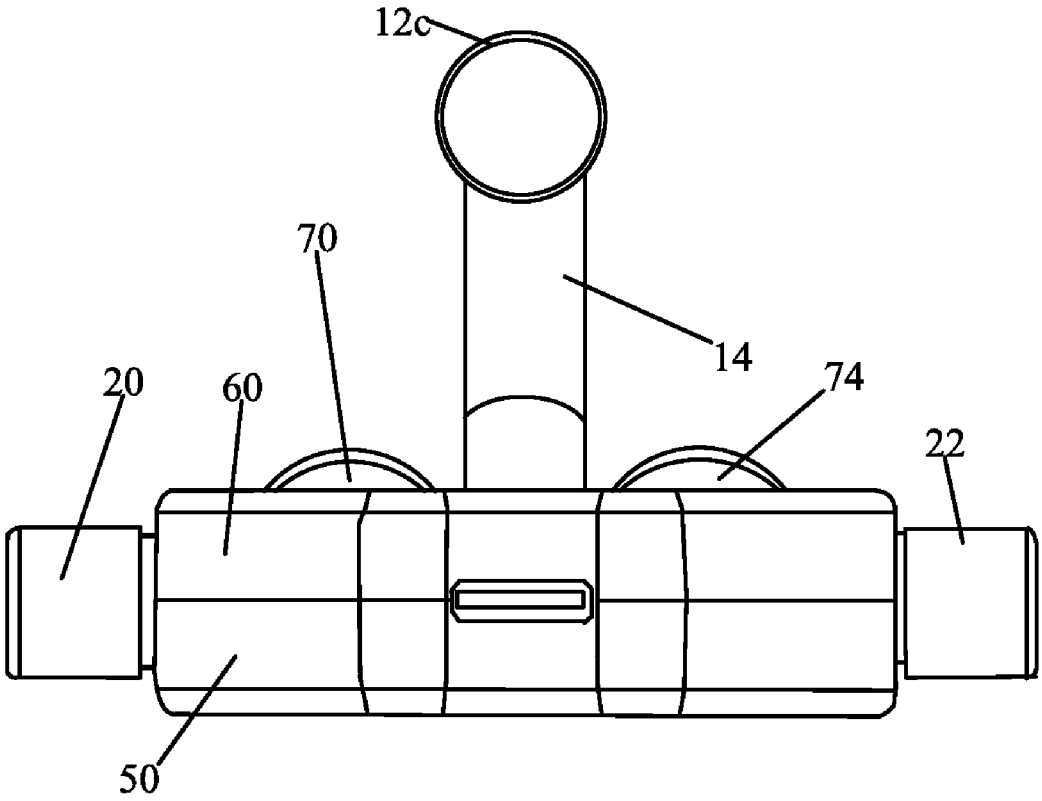
FIG. 12 shows a rear view of the apparatus of FIG. 1 with the apparatus in the second state.
Figure 13:
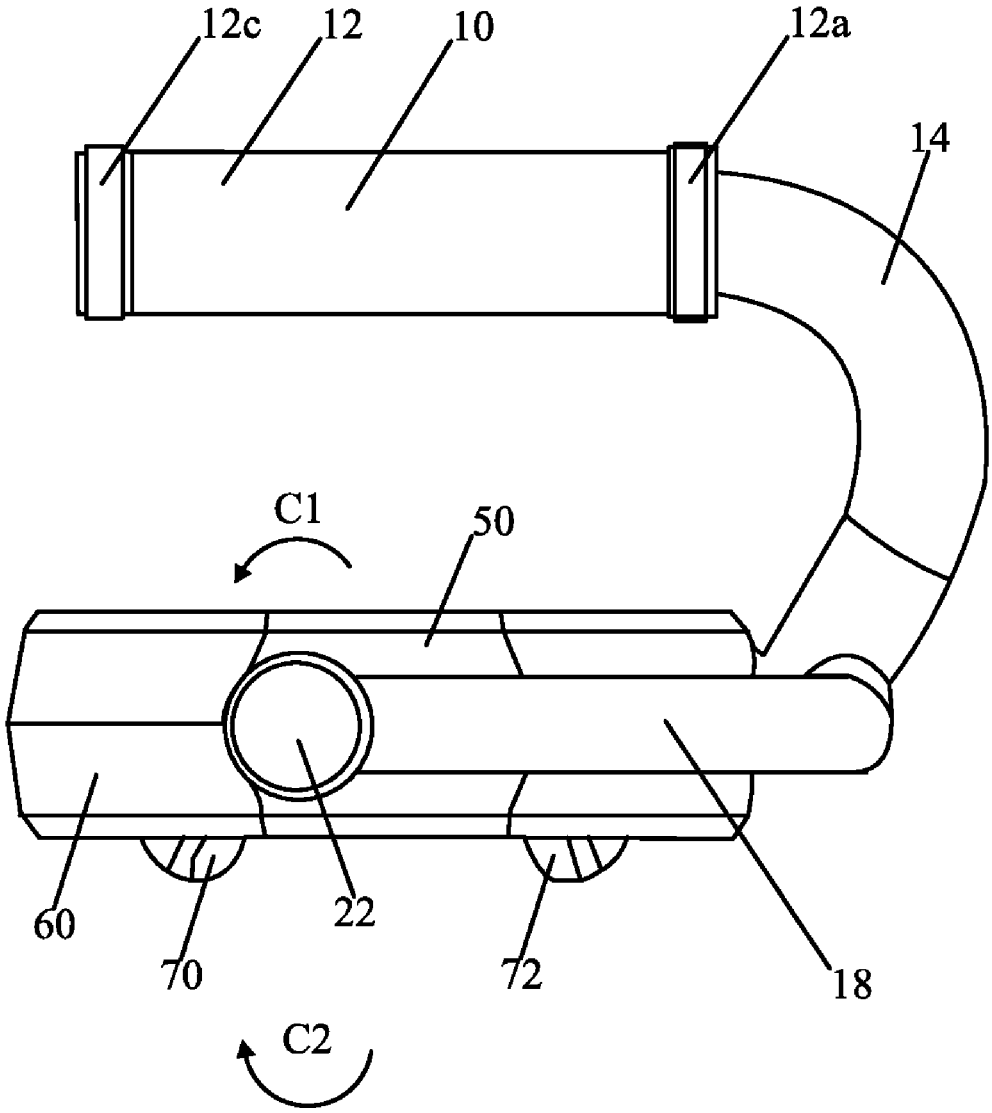
FIG. 13 shows a right side view of the apparatus of FIG. 1 with the apparatus in the first state.
Figure 14:
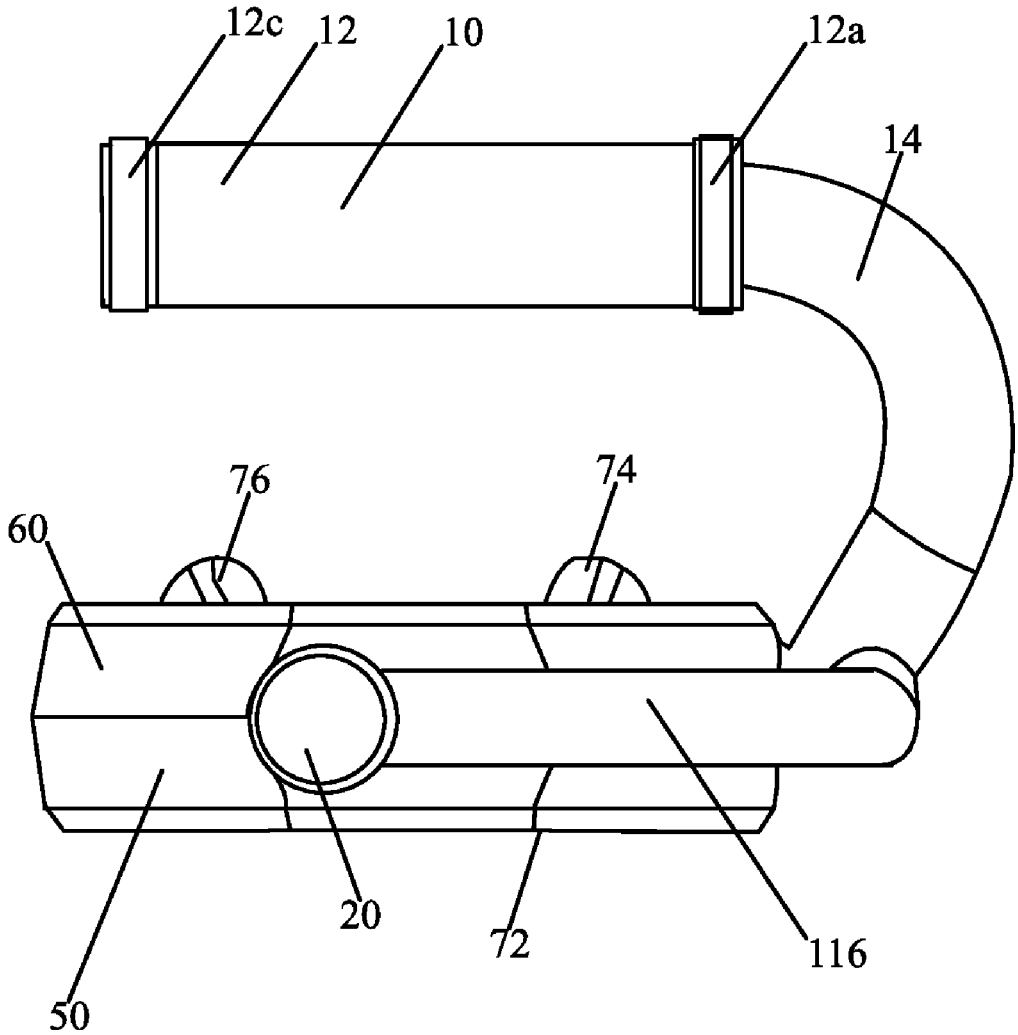
FIG. 14 shows a left side view of the apparatus of FIG. 1, with the apparatus in the second state.
Figure 15:
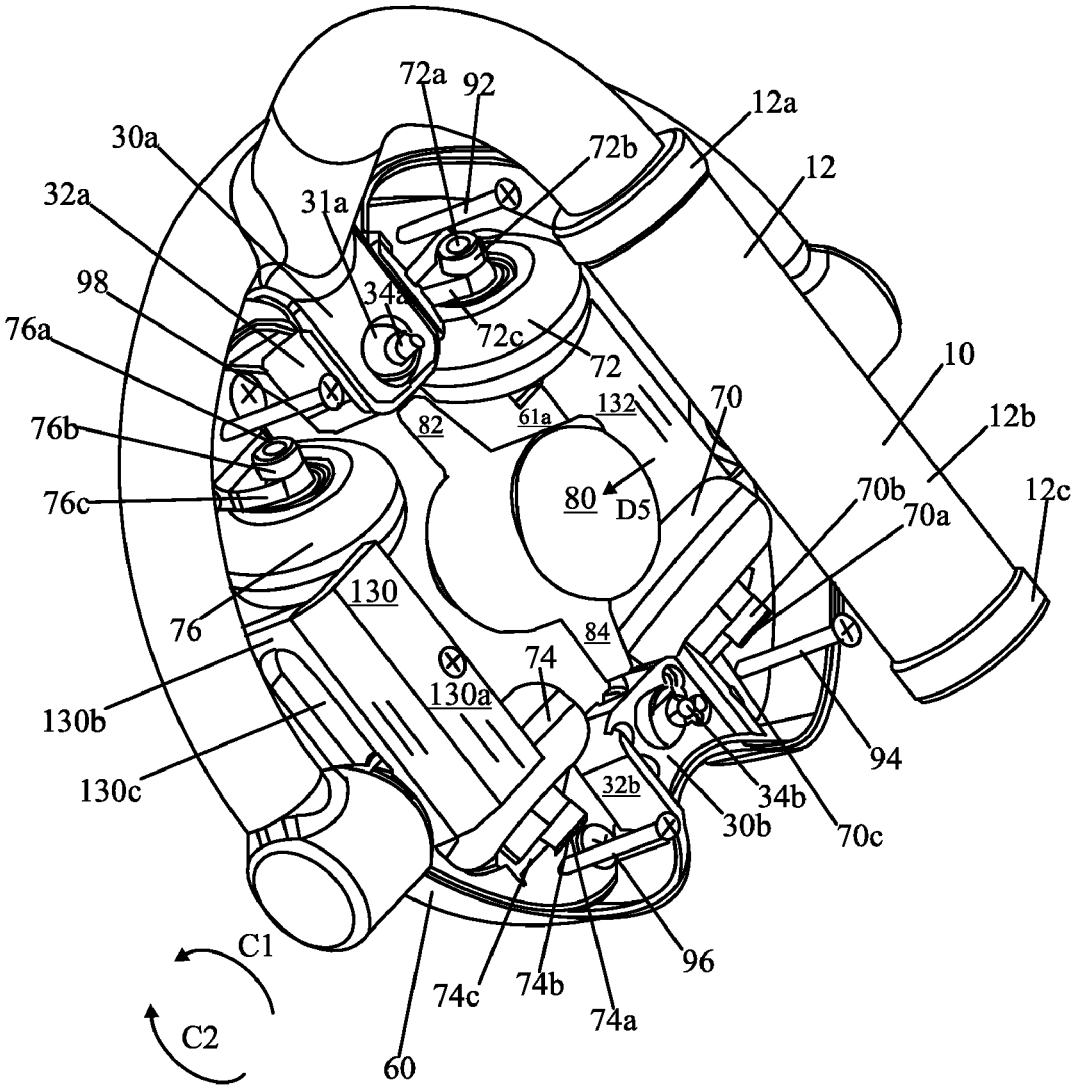
FIG. 15 shows another top perspective view of the part of the apparatus of FIG. 1, with the cover removed and with the handle in the orientation of FIG. 1.

FIG. 5 shows a bottom view of the apparatus 1, with the apparatus 1 in the second state. FIG. 6 shows a top view of the apparatus 1, with the apparatus 1 in the second state. FIG. 7 shows a front bottom perspective view of the apparatus 1, with the apparatus 1 in the first state. FIG. 8 shows a rear bottom perspective view of the apparatus 1, with the apparatus 1 in the first state. FIG. 9 shows a rear view of the apparatus 1, with the apparatus 1 in the first state. FIG. 10 shows a front view of the apparatus 1, with the apparatus 1 in the second state. FIG. 11 shows a front view of the apparatus 1, with the apparatus 1 in the first state. FIG. 12 shows a rear view of the apparatus, with the apparatus 1 in the second state. FIG. 13 shows a right side view of the apparatus 1 of FIG. 1 with the apparatus 1 in the first state. FIG. 14 shows a left side view of the apparatus 1 of FIG. 1, with the apparatus 1 in the second state. FIG. 15 shows another top perspective view of the part of the apparatus 1, with the cover or top housing 50 removed and with the handle 12 in the orientation of FIG. 1.

Referring to FIGS. 1-15, the handle device 10 includes handle or handle portion 12. The handle 12 includes clamps 12*a* and 12*c* which fix a material 12*b*, such as a rubber material for a rubber hand grip, to a tube or pipe 12*d*. The handle device 10 also includes curved pipes 14, 16, and 18. The pipes 16 and 18 may actually be one C-shaped pipe as shown by FIG. 8. The curved pipes 16 and 18 are fixed, such as by welding to pipe 14 at a first end. A second end of pipes 16 and 18 are fixed to knobs 20 and 22 respectively. The combination of pipes 16 and 18 or the combination of and pipes 16 and 18 and knobs 20 and 22 may be called a C-shaped member. The C-shaped member (including 16, 18, 20, and 22) may be connected to the base (which may include housing 50 and 60) so that the C-shaped member rotates with respect to the base (50 and 60). The C-shaped member (16, 18, 20, and 22) may be rotatably mounted at end or at knob 20 to one side of the base (50 and 60) and at opposing end or at opposing knob 22 to an opposing side of base (50 and 60), so that the C-shaped member rotates about an axis, such as axis L1 shown by dashed lines in FIG. 8, passing through ends or knobs 20 and 22.

An individual can grip the handle 12 in order to pick up the apparatus 1 or push up device along with another identical apparatus 1 or push up device to execute a push up in a conventional manner or in another manner.

The apparatus 1 includes a bottom housing 60 in which various components are located as shown in FIG. 3 and FIG. 15. For example, the apparatus 1 includes a device 80 which is fixed to an inner surface 61*a* of the bottom housing 60. Screws 92, 94, 96 and 98 are screwed into the bottom housing 60 and are used to hold the top housing 50 to the bottom housing 60.

The apparatus 1 includes wheels 70, 72, 74, and 76 which protrude through openings 62*b*, 62*c*, 62*d*, and 62*e* through the bottom surface 62*a* of the bottom housing 60 as shown in FIG. 2. The wheels 70, 72, 74, and 76 are also shown in FIG. 15. The wheels 72 and 76 spin on axles, such as a bolts 72*a* and 76*a*, respectively, which are inserted into an opening of brackets 72*c* and 76*c* and held by nuts 72*b* and 76*c*, respectively. The brackets 72*c* and 76*c* may be fixed at the same angle inward with respect to the outer surface 62*a* of the bottom housing 60 so that the wheels 72 and 76, respectively, are angled inward and in at least one embodiment, not substantially perpendicular and not perpendicular to the outer surface 62*a* of the bottom housing 60. The bolt 72*a* and 76*a* may be angled with respect to the outer surface 62*a* of the bottom housing 60 so that the bolts 72*a* and 76*a* are not perpendicular to the outer surface 62*a* of the bottom housing 60, but are perpendicular to the wheels 72 and 76.

Similarly, the wheels 70, and 74 spin on axles, such as a bolts 70*a*, and 74*a* which are inserted into openings of brackets 70*c*, and 74*c*, and held by nuts 70*b*, and 74*b*, respectively. The brackets 70*c* and 74*c* may be fixed at the same angle inward with respect to the outer surface 62*a* of the bottom housing 60 so that the wheels 70 and 74, respectively, are angled inward and in at least one embodiment, not substantially perpendicular and not perpendicular to the outer surface 62*a* of the bottom housing 60. The bolt 70*a* and 74*a* may be angled with respect to the outer surface 62*a* of the bottom housing 60 so that the bolts 70*a* and 74*a* are not perpendicular to the outer surface 62*a* of the bottom housing 60, but are perpendicular to the wheels 70 and 74, respectively. The wheels 70 and 74 are angled inwards towards the wheels 72 and 76 and the wheels 72 and 76 are angled inwards towards the wheels 70 and 74 in at least one embodiments.

The handle device 10 includes two lock covers or brackets 30*a* and 30*b* shown in FIG. 15 which are fixed to protrusions or lock cases 32*a* and 32*b*, respectively, of the bottom housing 60 by screws or mounting pins or locking mechanisms 34*a* and 34*b*, respectively. Depending on what state the handle device 10 is in, the locking mechanism 34*a* or 34*b* may prevent the handle device 10 from rotating in a counter clockwise direction C1 or a clockwise direction C2 shown in FIG. 13. For example, in the state shown in FIG. 15, the locking mechanism 34*a* prevents the handle device 10 from rotating in the directions C1 or C2 shown in FIG. 15. Either of the locking mechanisms 34*a* or 34*b* can be released or unlocked by pushing down on the device 80, in the direction D5, which is perpendicular or substantially perpendicular to the inner surface 61*a* of the bottom housing 60, shown in FIG. 15. When the device 80 is pushed down in the direction D5, the arms or members 82 and 84 are pushed down and pull the locking mechanisms or pins 34*a* and 34*b* down causing the locking mechanism 34*a* (in this case) to release from the opening 31*a* in the plate or lock cover 30*a*, which allows the handle device 10 to rotate in the directions C1 and C2. When the handle device 10 has been rotated one hundred eighty degrees from the state of FIG. 15, so that the locking mechanism 34*b* is within the opening 31*a* of the cover or plate 30*a*, the handle device 10 again cannot be rotated in the directions C1 and C2 until the device 80 is pushed downwards in the direction D5. With the locking mechanism 34*b* in the opening 31*a*, pushing down on device 80 causes the members 84 and 82 to pull the mechanisms 34*b* and 34*a* down, respectively, and in that case releases 34*b* from the opening 31*a* of the plate 30*a* to again allow rotation of handle device 10.

When the screw, mounting pin or locking mechanism 34*a* is removed or released, the handle device 10 can be rotated in the directions C1 or C2. The handle device 10 can be rotated about the axis of axle or bolts 102 and a similar bolt fixed to knob 20, to place the handle 12 into a position where the handle 12 is over the surface 52*a* as shown in FIG. 1, and then locked into the state of FIG. 1 with mechanism 34. The handle device 10 can also be rotated about the axis of axle or bolts 102 and a similar bolt fixed to knob 20, to place the handle 12 into a position where the handle 12 is over the surface 62*a* as shown in FIG. 2, and then locked into the state of FIG. 2 with mechanism 34.

FIG. 3 shows the apparatus 1, with the exception that the top cover or housing 50 has been removed and is not shown, so that internal components, which are typically located within the overall housing including the housings 50 and 60, are shown. The apparatus 1 includes brackets 130 and 132 shown in FIG. 3. The bracket 132 includes plate 132*a* and plate 132*b*. The plate 132*a* is typically fixed substantially perpendicular or perpendicular to the plate 132*b*. There is a slot 132*c* in the plate 132*b*. The bracket 132 may be made of a hard material such a metal or hard plastic. The bracket 132 is typically fixed to the bottom housing 60 such as by screws or in any other known manner. A bolt or axle 102, which is fixed to the member or knob 22, is shown inserted through the slot 132*c*. The bolt or axle 102 is fixed at a proximate or near end of the slot 132*c*. A nut or other fastener 112 holds the bolt or axle 102 in place at a location in the slot 132*c*. When the nut 112 is loosened the bolt 102 cannot be moved further in the direction D2 in the slot 132*c*, since the bolt is at the farthest end in the slot 132*c* in the direction D2 as shown in FIG. 3. However, when the nut 112 is loosened, the bolt 102 can be moved in the direction D1 until the bolt is at the farthest end in the direction D1 within the slot 132*c*. The bolt 102 can then be temporarily fixed, within the slot 132*c* with nut 112 at farthest end in the direction D1. The bolt 102 can be fixed at a variety of positions between the furthest end in the direction D1 and the furthest end in the direction D2, within the slot 132*c*.

Similarly, the bracket 130 includes plate 130*a* and plate 130*b*. The plate 130*a* is typically fixed substantially perpendicular or perpendicular to the plate 130*b*. There is a slot 130*c* in the plate 130*b*. The bracket 130 may be made of a hard material such a metal or hard plastic. The bracket 130 is typically fixed to the bottom housing 60 such as by screws or in any other known manner. A bolt or axle not shown in FIG. 3, but similar or identical to bolt 102, is fixed to the member or knob 20, and is inserted through the slot 130*c*. The bolt or axle (which is fixed to knob 20) is fixed at a proximate or near end of the slot 130*c*. A nut or other fastener (similar or identical to nut 112) holds the bolt or axle (which is fixed to knob 20) in place at a location in the slot 130*c*. When the nut (not shown but similar or identical to 112) is loosened the bolt (which is fixed to knob 20) cannot be moved further in the direction D2 in the slot 130*c*, since the bolt is at the farthest end in the slot 130*c* in the direction D2 as shown in FIG. 3. However, when the nut (not shown but similar or identical to 112) is loosened, the bolt can be moved in the direction D1 until the bolt is at the farthest end in the direction D1 within the slot 130*c*. The bolt (fixed to knob 20) can then be temporarily fixed, within the slot 130*c* with the nut (similar to 112, but not shown) at farthest end in the direction D1. The bolt (fixed to knob 20) can be fixed at a variety of positions between the furthest end in the direction D1 and the furthest end in the direction D2, within the slot 130*c*. The handle device 10 (such as for example, including components 12, 14, 16, 18, 20, and 22) can be moved without rotating the handle device 10, so that the bolt 102, while in slot 132*c* and an additional bolt (not shown) in slot 130*c* in FIG. 3 move in the directions D2 or D1 when the nut 112 (for slot 132*c*) and a similar nut not shown for slot 130*c* are loosened.

FIGS. 9 and 11 show a situation where the apparatus 1 has been put in a state where the handle 12 of the handle device 10 is above the surface 52*a* and closer to the surface 52*a* and the housing 50 than to the bottom surface 62*a* of the bottom housing 60, so that the wheels 70, 72, 74 and 76 are simultaneously placed on and in contact with the floor surface 200. The wheels 70, 72, 74, and 76, as shown by FIG. 5 and FIG. 15 may be oriented in the same direction such that there axles or bolts 70*a*, 72*a*, 74*a*, and 76*a* are parallel to each other or substantially parallel to each other. In at least one embodiment the wheels 70, 72, 74, and 76 may roll in the directions D6 and D7 shown in FIG. 5, but may otherwise be fixed so they do not roll in other directions or cannot pivot to roll in other directions. As shown by FIG. 5, in at least one embodiment, the wheels 70, 72, 74, and 76 may be angled to the bottom surface 62*a*, and thus will be angled with respect to the floor surface 200 for the FIGS. 9 and 11 configuration. The angling of the wheels 70, 72, 74, and 76 increases the stability of the apparatus or pushup device 1.

Typically in operation, the user will use two pushup devices each identical to apparatus or pushup device 1. The user will place each apparatus 1 in the same state, such as in a state where the handle 12 is closer to the surface 52*a* than the surface 62*a*, so that wheels 70, 72, 74, and 76 will come in contact with a floor surface such as 200, or in a state where the handle 12 is closer to the surface 62*a* than the surface 52*a*, so that surface 52*a* will contact the floor surface 200. After the handle device 10 is locked in the particular state, using locking mechanism 34*a* or 34*b*, so that the handle device 10 cannot rotate about the axis of knobs 20 and 22 with respect to the base (comprised of housing 50 and housing 60), an individual can do a push up exercise using the two pushup devices 1. The individual would grab a handle 12 of one push up device 1 with one hand and grab a handle 12 of the second push up device 1 with the other hand and then perform a push up exercise. The pushup devices 1 will remain stationary if the surface 52*a* contacts the surface 200. The pushup devices 1 will roll outwards or inward if the wheels 70, 72, 74, and 76 contact the surface 200.

Although the pushup device or apparatus 1 is illustrated throughout the drawings as a four wheeled device, the apparatus 1 may be equipped with virtually any conventional type of rolling including two wheeled assembling with wide cylinder type wheels placed parallel.

The base (including housings 50 and 60) of the apparatus 1 may be made of plastic. Alternatively, other materials (e.g. carbon fiber, and/or other light durable components, etc.) may be used for large scale production, if so desired.

The handle device portions 12*d*,14, 16, 18, 20 and 22 may be made of steel. The grip or portion 12*b* may made of foam rubber or other suitable material. Alternatively, an angle of the upper side or portion 12*d* of the handle device 10 to the vertical part or portion 14 of the handle device 10 may be changed allows the user's arms to use the apparatus 1 more naturally during a push-up.

Figure 16A:
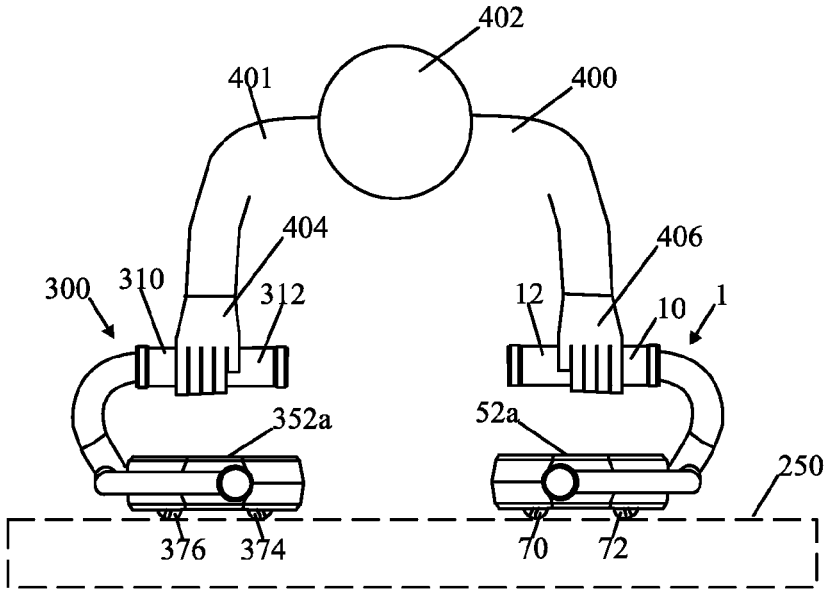
FIG. 16A shows a simplified diagram of a head on view of a person using the apparatus of FIG. 1 with an identical apparatus for performing a push up exercise, with side views of the two apparatus shown.
Figure 16B:
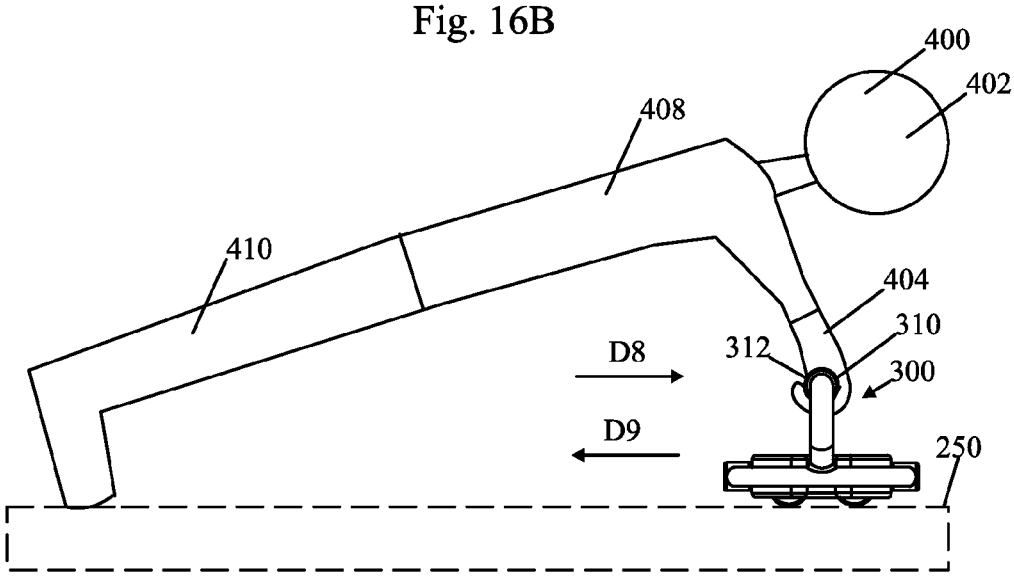
FIG. 16B shows a simplified diagram of a side view of the person of FIG. 16A with a rear view of one of the two apparatus from FIG. 16A shown.

FIG. 16A shows a simplified diagram of a head on view of a person 400, having a head 402, using the apparatus 1 with an identical apparatus 300 for performing a push up exercise, with side views of the apparatus 1 and 300 shown. FIG. 16B shows a simplified diagram of a side view of the person 400 of FIG. 16A with a rear view of one of the two apparatus 1 and 300 from FIG. 16A shown. Referring to FIGS. 16A and 16B, a right hand 404 of the person 400 is gripping a handle 312 of a handle device 310 of the apparatus 300, while simultaneously a left hand 406 of the person 400 is gripping a handle 12 of the handle device 10 of the apparatus 1. The apparatus 1 and the apparatus 300 sit on a floor or floor surface 250, and are both in a state such that their wheels contact the floor 250. Wheels 376 and 374 of apparatus 300 (and another two wheels similar to wheels 70 and 72 but not shown in FIG. 16A) and wheels 70 and 72 of apparatus 1 (and wheels 74 and 76 not shown in FIG. 16A) contact and/or rest on the floor 250. As shown by FIG. 16B the person 400 may keep their back 408 and their legs 410 straight and may perform a conventional pushup exercise. Alternatively, or additionally, the person 400 may move and/or roll the apparatus 1 and the apparatus 300 in the directions D8 and/or D9 while executing the push up exercise to exercise various muscle groups.

FIGS. 16A and 16B show merely one example of an exercise which can be done in accordance with an embodiment of the present invention. The apparatus 1 and 300 can be placed in states such that the handles 12 and 312 are closer to the wheels 70 and 72, and 376 and 374, respectively, than the top surfaces 52*a* and 352*a*, such that the surfaces 52*a* and 352*a* will contact a surface such as floor 250. In such a scenario, the apparatus 1 and 300 would not roll during a push up exercise. In addition, the apparatus 1 and 300 are shown in FIG. 16A with the handles 12 and 312 parallel to the shoulders 401 of the person 400, but could be placed in a different orientation such as perpendicular to the shoulders 401 of the person 400.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising: a handle device having a handle; and a base having a top surface and an opposing bottom surface; and wherein the handle device is connected to the base so that the handle device can be placed in a first state in which the handle is temporarily fixed at a position which is closer to the top surface of the base than the bottom surface of the base, and so that the handle device can be placed in a second state in which the handle is temporarily fixed at a position which is closer to the bottom surface of the base than the top surface of the base; and further comprising one or more wheels which protrude outward from the bottom surface of the base in the second state but which do not protrude outward from the top surface of the base in the first state; wherein the handle in the second state overlaps the bottom surface of the base and is substantially parallel to the bottom surface of the base; the handle device is connected to the base so that the handle device is adapted to rotate with respect to the base in order to change the handle device from the first state to the second state; the base has a slot and the handle device has an axle; and further comprising means for fixing the axle at a position within the slot, and for allowing the axle to move from one position to another position within the slot; wherein the axle, when not fixed at a position within the slot, can be moved to different positions within the slot to move the handle device without rotating the handle device; and wherein when the axle is fixed at a position within the slot, the handle device can be rotated about the axle.

2. An apparatus comprising: a handle device having a handle; and a base having a top surface and an opposing bottom surface; and wherein the handle device is connected to the base so that the handle device can be placed in a first state in which the handle is temporarily fixed at a position which is closer to the top surface of the base than the bottom surface of the base, and so that the handle device can be placed in a second state in which the handle is temporarily fixed at a position which is closer to the bottom surface of the base than the top surface of the base; and further comprising one or more wheels which protrude outward from the bottom surface of the base in the second state but which do not protrude outward from the top surface of the base in the first state; wherein the handle in the second state overlaps the bottom surface of the base and is substantially parallel to the bottom surface of the base; wherein the handle device includes a C-shaped member having a first end and a second end, wherein the first end of the C-shaped member is rotatably mounted to a first side of the base, and the second end of the C-shaped member is rotatably mounted to a second side of the base, which is opposite the first side of the base, so that the C-shaped member can rotate with respect to the base about an axis passing through the first end and the second end of the C-shaped member; and wherein the handle device includes a first further member having a first end and a second end; and wherein the first further member is attached at its first end substantially at a midpoint of the C-shaped member, and wherein the first further member is attached at its second end to the handle.

3. The apparatus of claim 1 wherein the handle device includes a C-shaped member having a first end and a second end, wherein the first end of the C-shaped member is rotatably mounted to a first side of the base, and the second end of the C-shaped member is rotatably mounted to a second side of the base, which is opposite the first side of the base, so that the C-shaped member can rotate with respect to the base about an axis passing through the first end and the second end of the C-shaped member.

4. The apparatus of claim 3 wherein the handle device includes a first further member having a first end and a second end; and wherein the first further member is attached at its first end substantially at a midpoint of the C-shaped member, and wherein the first further member is attached at its second end to the handle.

5. The apparatus of claim 1 wherein the handle is substantially cylindrically shaped.

6. The apparatus of claim 1 further comprising a locking mechanism for temporarily locking the handle device in the first state.

7. The apparatus of claim 6 further comprising an unlocking mechanism for allowing the handle device to be changed from the first state to the second state.

8. The apparatus of claim 5 wherein the top surface includes a non-skid material.

9. The apparatus of claim 5 wherein the one or more wheels are fixed with respect to the base so that the one or more wheels are angled with respect to the bottom surface of the base.

* * * * *